US008746328B2

(12) United States Patent
White

(10) Patent No.: US 8,746,328 B2
(45) Date of Patent: Jun. 10, 2014

(54) GAS INJECTION HEATING PROBE

(75) Inventor: Christopher White, Denham Springs, LA (US)

(73) Assignee: Braid Logistics North America, LLC, Denham Springs, LA (US)

( * ) Notice: Subject to any disclaimer, the term of this patent is extended or adjusted under 35 U.S.C. 154(b) by 0 days.

(21) Appl. No.: 13/548,334

(22) Filed: Jul. 13, 2012

(65) Prior Publication Data

US 2013/0258798 A1 Oct. 3, 2013

Related U.S. Application Data

(63) Continuation of application No. PCT/US2011/022580, filed on Jan. 26, 2011.

(60) Provisional application No. 61/298,777, filed on Jan. 27, 2010.

(51) Int. Cl.
*B01F 13/02* (2006.01)

(52) U.S. Cl.
USPC ..... 165/155; 165/164; 366/101; 366/107; 366/147; 366/148

(58) Field of Classification Search
USPC ..... 165/154, 155, 164; 366/101, 106, 107, 366/147, 148; 261/127
See application file for complete search history.

(56) References Cited

U.S. PATENT DOCUMENTS

| | | | | | |
|---|---|---|---|---|---|
| 59,363 | A | * | 11/1866 | Comstock | 165/154 |
| 69,576 | A | * | 10/1867 | Nicholson | 165/154 |
| 93,207 | A | * | 8/1869 | Kegg | 261/127 |
| 596,330 | A | * | 12/1897 | Maiche | 165/164 |
| 830,248 | A | * | 9/1906 | Von Orth | 165/154 |
| 1,346,537 | A | * | 7/1920 | Flowers | 202/187 |
| 2,469,259 | A | * | 5/1949 | Burgess | 62/406 |
| 2,532,995 | A | * | 12/1950 | Chausse | 165/163 |
| 2,778,609 | A | * | 1/1957 | Peeps | 165/164 |
| 3,517,732 | A | | 6/1970 | Brebant | |
| 4,014,384 | A | * | 3/1977 | Marcus | 165/10 |
| 4,090,558 | A | * | 5/1978 | Akama | 165/155 |
| 4,393,925 | A | * | 7/1983 | Jacobsen et al. | 165/122 |
| 5,181,655 | A | | 1/1993 | Bruckelmyer | |
| 5,503,220 | A | | 4/1996 | Wood et al. | |
| 5,509,462 | A | * | 4/1996 | Demko et al. | 165/45 |
| 5,878,579 | A | | 3/1999 | Boyer, III | |
| 7,607,898 | B2 | | 10/2009 | Noble et al. | |
| 2006/0114744 | A1 | | 6/2006 | White et al. | |

OTHER PUBLICATIONS

US as International Searching Authority, Search Report and Written Opinion, dated Mar. 18, 2011, for PCT/US2011/022580.

(Continued)

*Primary Examiner* — David Sorkin
(74) *Attorney, Agent, or Firm* — Jones Walker LLP

(57) ABSTRACT

A gas injection heating probe, where the probe has a hollow injection channel, a heating media inlet, a heating media outlet, a gas injection fitting and heat exchange area. The gas injection heating probe is connectable to a heated media and a source of gas, so that when connected and inserted into a container having product, the probe provides for gas injection and heating of the product to assist in mixing the product for discharge.

6 Claims, 3 Drawing Sheets

(56) References Cited

OTHER PUBLICATIONS

WIPO International Publication, Int'l Publication No. WO 2011/094314 A1, publication date Aug. 4, 2011, for International Application No. PCT/US2011/022580 filed Jan. 26, 2011, for Applicant: Christopher White.

US as International Searching Authority, International Preliminary Report on Patentability, dated Aug. 9, 2012, for PCT/US2011/022580.

* cited by examiner

GAS INJECTION HEATING PROBE

PRIORITY CLAIM

This application is a continuation of Patent Cooperation Treaty application number PCT/US2011/022580, filed Jan. 26, 2011, which claimed the priority benefit of U.S. Provisional patent application number 61/298,777, filed on Jan. 27, 2010. The contents of each are incorporated by reference and priority to each is claimed.

FIELD OF INVENTION

This invention relates to a gas injection heater probe for flexible bulk fluid container bags (hereafter "Flexi Tanks") and other containers, and methods to empty containers filled with highly viscous products. The same technology can be applied to other flexible shipping containers such as "Super Sacks" and "Bulk Bags." Additionally, the technology can also be used for rigid shipping containers such as ISO Tankers, road tankers and rail tankers.

BACKGROUND OF INVENTION

Many fluids are transported in bulk containers, such as ISO tanks and shipping containers, railcar containers, 55 gallon drums, and other bulk containers. Highly viscous fluids present particular transportation problems for Flexi Tanks: ease of discharge of a filled container.

Non-limiting examples of highly viscous fluids includes pepper mash (or other vegetable or fruit mash), syrups, such as corn, palm oil or other vegetable oils such as olive oils, inks, resins, cooking oils and lubricants. During transportation, these types of products will become more viscous because of the reduction in product temperature resulting from exposure to ambient temperature conditions. Upon arrival at the discharge location, this increase in product viscosity presents problems. The lower product temperature and viscosity often makes it impossible to pump or gravity discharge the product.

To assist in unloading containers filled with highly viscous products, heat can be applied to the container holding the product to indirectly increase the product temperature and therefore reduce the product viscosity. Enough heat has to be applied to make the product capable of flowing. As an example, TOD/Charlie Nelson/Cargill has developed a heater pad that is placed underneath a flexible shipping container before shipment. Upon reaching the unloading point, the pad is filled with a heating media such as low pressure steam or hot water, and heat transferred from the pad to the container, then to the product in the container by thermal conduction. However, the heating pad and Flexi Tank are constructed of a polymer material and therefore are poor conductors of heat energy. Additionally, because there is no movement or agitation of the product inside the container, this method is relying on the convective transfer of energy to the product inside the container, and results in inefficient heat transfer. Because of the materials of construction of the Flexi Tank/Heater Pad and the lack of fluid motion in the Flexi Tank, the overall heat transfer coefficient is extremely low. For this reason, this method is very time and energy intensive. Because of the existing inefficiencies, heat transport in a viscous fluid can be slow and inefficient, and hence, smaller containers, such as a 300 gallon container, are used to reduce the fluid volume to be heated. Even with these smaller containers, heat time and discharge times can still be excessive.

In an effort to improve the efficiency of this heat transfer, agitation can be imparted into the product in the container. Gas (e.g. air) injection is one method used to mix products inside containers. See U.S. Pat. No. 4,595,296 to Parks (incorporated by reference). More specifically, Chris White (U.S. patent application Ser. No. 11/326,738, now U.S. Pat. No. 7,744,268) has developed a method to mix viscous products inside of a flexible container using gas injection, ultimately reducing the energy and time needed to heat a product to a flowing state (hereby incorporated by reference).

SUMMARY OF INVENTION

A gas injection heating probe designed to include an external jacket that holds a heating media and a hollow shaft portion to allow gas injection for liquid agitation. The probe is preferably constructed of a rigid metal or other material of sufficient thermal conductivity that is compatible with viscous products to be heated. An air or gas injection probe (used for product agitation, such as disclosed in the U.S. Pat. No. 7,744,268) is preferably jacketed with a heat transfer material to provide a heat transfer surface in direct contact with the product to be heated. The heat transfer surface area is preferably of high surface area, such as having finned geometry, in order to maximize the amount of surface area for efficient heat transfer. The gas injection heating probe preferably includes a fitting device that allows it to be secured to a flexible shipping container (Flexi Tank) of any size (reference FIG. 2). The fitting may not be needed when using the probe with a fixed walled tank or container. The probe includes a heating media inlet and outlet connection to allow for the circulation of a heating media (steam, hot water, hot oil, etc.) through the heating probe jacketing. The probe includes a gas connection to allow for the injection of gas through the probe for the purposes of agitating the product inside the flexible container. This probe is connected to a gas injection controller to control the timing/sequence and duration of the injected sequence. This probe is also connected to a heat transfer media control system that allows for the control of temperature of the product inside of the flexible container. A sample of a suitable heat transfer media control system would be a Pick Heaters, Inc. 6'×10' Hot Water System available from Pick Heaters, Inc. of West Bend Wis.

OBJECTS OF INVENTION

It is an object of this invention to provide a time and energy efficient method of heating highly viscous products inside of transport containers.

It is an object of the invention to provide heat transfer inside of transport containers to allow for direct contact between the heat transfer surface area and the product as opposed to having the heat transfer surface area transmitting through the container.

It is an object of this invention to provide a system to agitate the product inside of a transport container while simultaneously conducting heat transfer.

It is an object of this invention to provide a method to reduce the heat up time required to heat viscous fluids in a shipping container such as a Flexi Tank.

It is an object of this invention to provide a method to reduce the energy required to heat viscous fluids in a shipping container such as a Flexi Tank.

DETAILED DESCRIPTION OF THE INVENTION

The following description is for use of one embodiment of the probe in a Flexi Tank, but the invention is not so limited, and may be used with other bladder containers as well as rigid containers.

Figure 1A:
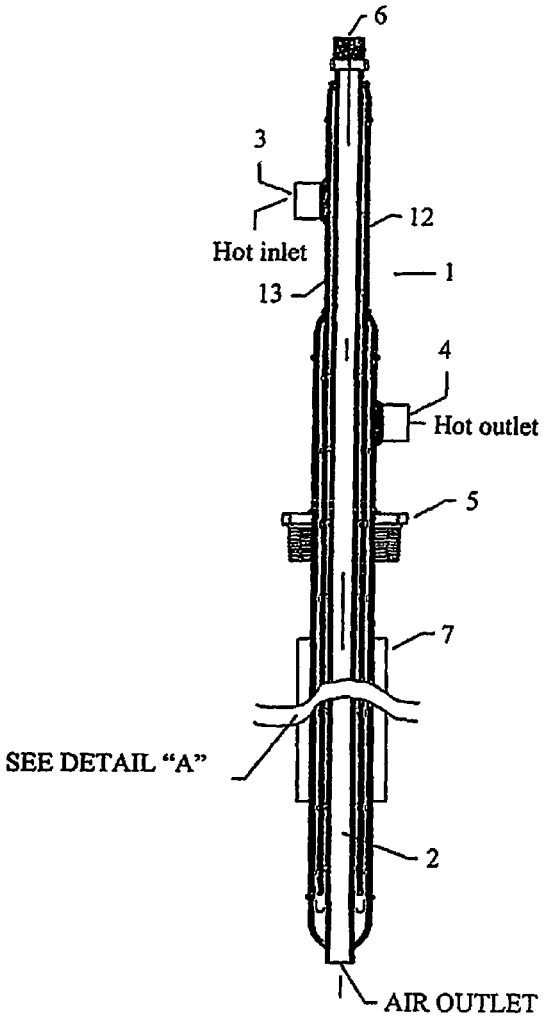
FIG. 1*a* depicts a lengthwise cross section of one embodiment of a gas injection heating probe.
Figure 1B:
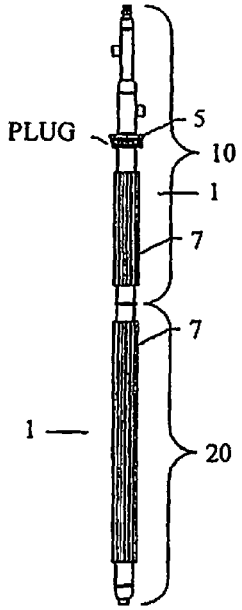
FIG. 1*b* is a prospective view of one embodiment of a gas injection heating probe.
Figure 1C:
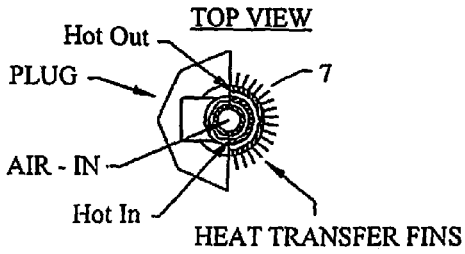
FIG. 1*c* depicts a partial horizontal cross section through one embodiment of a gas injection heating probe.
Figure 2:
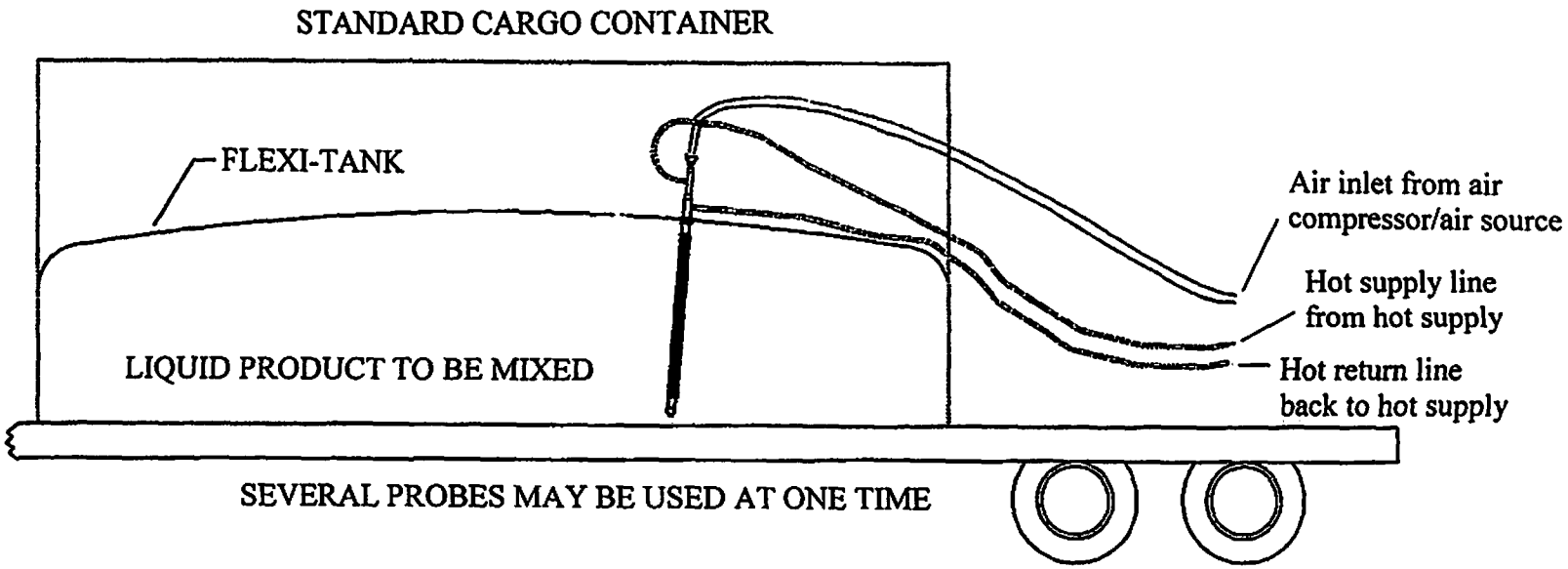
FIG. 2 is a cartoon depiction of one embodiment of the probe as used in a Flexi Tank.

FIG. 1*a* is a side schematic of one embodiment of a gas injection heating probe 1 demonstrating the heat transfer surface area 7, the heat exchanger (here shown as a finned surface surrounding the exterior wall of the jacket), heat transfer media connections 3 and 4, gas connection 6. FIG. 1*b* also demonstrates one design of the probe 1 that allows the probe to separated into multiple pieces (here two pieces, 10 and 20) to allow for ease of insertion into a shipping container, such as Flexi Tank, where access to the top of the tank may be limited (for instance, if the bag is positioned in a closed transport container resulting in limited head space above the top of the container, such as shown in FIG. 2).

The gas injection heating probe 1 preferably has the heat transfer area constructed of metal or other materials that are heat conductive (e.g. having high thermal conductivity). For instance, metals or other materials (generally, thermal conductively greater than 10 $Wm^{-1}K^{-1}$) can be used to construct the heat exchanger. Other materials with lower thermal conductivity (for instance, a plastic binder with high thermal conductively material embedded in the binder) may be used when needed for product inertness, or for other reasons. Additionally, the heat transfer area may be coated with a thin layer of inert materials of lower conductivity to protect the metal (for instance a metal finned area may be coated with an inert plastic material for mixing corrosive or caustic products). For use in food materials, 316 Stainless Steel can be used, both for the probe and the heat transfer area. Other materials are suitable as long as they are compatible with the product being heated. Aluminum and copper may be used, and steel may be used for instance, in non-food products. The probe's dimensions can vary depending on the size of the flexible shipping container. For one embodiment, a probe of approximately 68 inches long, (with a 44 inch long inserted length), with a cross sectional diameter of about 3 inches is suitable, with the probe piping (not including the finned area) of approximately 1.5 inches in diameter.

Figure 1D:
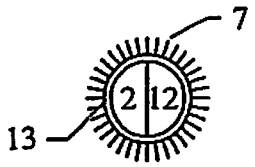
FIG. 1*d* depicts a horizontal cross section through another embodiment of a gas injection heating probe.
Figure 1E:
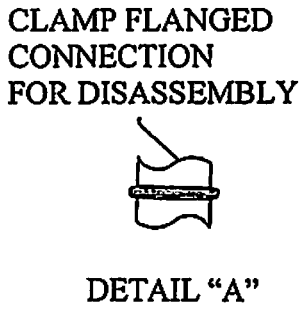
FIG. 1*e* depicts one embodiment of the joint between a two piece gas injection heating probe.

As shown in FIG. 1*a*, one embodiment of the probe 1 includes a hollow gas injection channel 2 (preferably the innermost portion of the probe, as shown in FIG. 1*a*), a heating media inlet 3 in fluid communication with a fluid inlet path 12, and a heating media outlet 4, in fluid communication with a fluid return path 13. Preferably, the gas injection channel 2 is an innermost cylinder, of a diameter of about ½ inch, that opens on the bottom of the probe, with the fluid inlet path 12 being an inner annular cylinder surrounding a portion of the gas injector channel 2, and the fluid return path 13 being an outer annular cylinder surrounding the fluid inlet path 12, and the fluid return path 13 is in fluid communication with the fluid inlet path near the injector end of the probe (the bottom of the probe—i.e., distal from the fittings). The heat transfer area or heat exchanger 7 is mounted on the outer surface of the fluid return path 13 to provide for transfer of heat energy via conduction from the fluid in the fluid return path to the heat transfer area. Obviously, the flow relationship of the fluid return path and fluid inlet path may be reversed. Additionally, other geometries other than nested channels may be used, such as a single cylindrical probe having two or more compartments, such as created with internal baffling in the probe, where at least one of the compartments is an injection channel 2, one compartment serves as the fluid inlet path 12, and another compartment serves as the fluid return path 13 (see FIG. 1*d*). This is generally not preferred as the exterior surface of the probe has areas that have temperature differences. Additionally, it is preferred that the various paths and channels be contained or bundled into a unitary body probe, but this is not required.

The probe shown in FIG. 1*a* includes a secure fitting 5, a gas injection fitting 6 attachable to a gas or air injection supply and in communication with the air injection channel 2, a heat inlet fitting 3 in communication with the fluid inlet path 12, and a heat outlet fitting 4 in communication with the fluid return path 13. The heat inlet and outlet fittings 3, 4 are connectable to a heated fluid source and pump, to pump fluid through the probe (see FIG. 2) via the fluid input paths and fluid return paths.

As shown in FIGS. 1*a* and 1*b*, the heat transfer area 7 is a finned area located lengthwise on the exterior surface of the probe. The fins may be orientated longitudinal (as shown) or circumferential on the probe. To maximize this surface area, fins are preferred, but other high surface area configurations may be used, such as a sponge like thermal conductive material attached to the exterior surface of the probe 1.

In construction, hollow gas injection channel 2 can be of different diameters dependent on the volume of gas and the pressure of the injected gas needed to properly agitate the product inside the transport container. Heating media inlet 3 and heating media outlet 4 can be constructed of various different fitting types. Non-limiting examples of these fitting can be threaded (NPT, BSPT), flanged, cam lock quick connects, or sanitary tri-clover fittings. Size of these fittings are dependent on the type and volumetric rate of the heat transfer media. Preferably, the inlets and outlets are located above the heat transfer area 7, and also above the secure fitting 5 if present on the probe.

As shown in FIG. 1*a*, the probe is designed such that the heating media supply is channeled first through the inner annular fluid inlet path 12, down the probe to near the injection end of the probe (that portion of the probe distant from the fittings). Upon reaching the lower portion of the probe, the heating media flows up the probe outer annular cylinder, the fluid return path 13, allowing heat to be transferred from the media to the heat transfer area 7 in contact with the outer wall of the outer annulus. With this circulation path, heat transfer area near the bottom of the probe, where air agitation is most efficient, will also be more efficient near the bottom of the probe than near the top of the probe. However, the direction of fluid flow may be reversed.

Figure 1F:
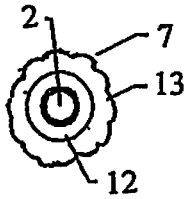
FIG. 1*f* shows a cross section through another embodiment of the gas injection heating probe.

Additionally, the heat exchanger surface geometry can vary dependent on the heat load required to timely increase the product temperature to achieve the desired reduction in viscosity. This can be accomplished by extending/shortening the length of the heat transfer surface area 7 on the probe 1, changing the surface area by adding additional heat transfer area (such as increasing the number of fins on the exterior surface of the probe, or the size of the fins, etc.). The heat exchanger may also form the exterior surface of the fluid return path, such as in a convoluted fluid return path exterior surface, shown in cross section in FIG. 1*f*.

Gas injection heater probe 1 can be designed with a coupling that allows the probe to be broken into multiple pieces or sections creating a sectional probe, such as shown in FIG. 1*b* (sections 10 and 20). This provides for ease of installation of the probe 1 into containers that have limited head space, and also ease of transportation. When the probe is a sectional probe, each compartment (air injection channel, fluid inlet and fluid return paths), should be sealed at the joint with seals, such as static O-ring seals or gaskets, or other sealing means, to insure that there is no leakage of the heating media into product being heated, or leakage of the heating media into the air injection chamber or vice versa.

Secure fitting 5 is designed to allow the probe to be sealing coupled to the container, such as a flexible container. The size and type of this fitting will be determined by the fitting design on the top of the flexible container. One type of fitting used on Flexi Tanks is disclosed in U.S. Pat. No. 7,744,268. However, for a non-flexible container, a secure fitting may not be required.

Gas injection fitting 6 can be constructed of various types of fittings, such as by a threaded fitting, quick connect, or other sealing fitting. The size of this fitting will be determined by the volume of air required to adequately mix the product inside of the flexible container and the size of the air transfer channel.

During use, the gas injection heating probe is inserted into a flexible container through a sealable opening on the surface of the flexible container. The probe is secured to the flexible container opening using the secure fitting 5, that is sealingly attachable to the opening. The probe 1 should be of a length sufficient to reach near the bottom of the container, but preferably not actually contacting the bottom of the container. A gas line is connected to the probe at the gas injection fitting 6 to allow the introduction of gas to product, achieving air injection and hence product agitation. Gas can be air, nitrogen or other inert gas, such as compressed or blown gas that is compatible with the fluid to be agitated (e.g. not substantially reactive with the product to be mixed). A heat transfer media line is connected to the heating media inlet 3 and a heat transfer return line is attached to the heating media outlet 4, to allow the heating media to circulate through the probe, transferring heat to the product in the container. The heated fluid media through the probe is closed (e.g. the heated media does not exit the probe).

The returned heat transfer media can then be re-heated and returned to the heating media inlet 3 (e.g. a close system) or simply be discarded. The gas injection heating probe 1 preferably will remain immersed in the flexible container with heating media flowing through it until the product inside the container has reached the desired temperature. Upon reaching the desired temperature, the heating media can be stopped from circulating through the probe, to allow the probe to cool. Once the probe reaches a temperature that allows for safe handling, the probes may then be removed to facilitate the unloading process of the flexible container.

Several heated gas injection probes can be used simultaneously in a single container, through different openings in a flexible container (or even through a single opening, such as in a fixed wall container manway opening), as necessary to conduct the heat transfer requirements in a timely manner. For instance, six heater probes would be a typical arrangement for a 23,000 liter Flexi Tank. The heater probes may be manually moved within the tank to reposition the point of agitation in the tank.

While heating is undertaken, gas injection may take place simultaneously. Gas may be injected in a pulsed fashion as described in U.S. Pat. No. 7,744,268. Gas injection may take place separately from the heating aspect of the probe, and conversely, heating may take place separately from the gas injection. For instance, at start up, both gas injection and heating may occur, with the gas injection being intermittent to allow for pulsing of the product with air. When the product is sufficiently flowable for discharge, heat exchange may cease to allow the probe to cool, but air injection may be maintained while the product is discharged from the container.

For heating viscous fluids, current techniques include heating the product in the container with a portable heating pad that is installed underneath the Flexi Tank. Introducing a heat transfer surface area directly in contact with the product, and movable within the product through the use of the heat transfer injection probe in conjunction with air agitation, decreases the time to raise the temperature of the product to the desired temperature for discharge. The increased efficiency of providing agitation, while introducing the heat transfer media directly to the fluid to be heated, can eliminate the standard method of indirectly heating the container with a heating pad.

The heat transfer injection probes, transport container, heating media system and air injection system provides a fluid transport system capable of dealing with high viscosity fluids. Although the present invention has been described in terms of specific embodiments, it is anticipated that alterations and modifications thereof will no doubt become apparent to those skilled in the art.

I claim:

1. A gas injection heating probe comprising a probe body having cylindrically shaped exterior wall, said wall having an interior wall surface and an exterior wall surface defining a probe interior positioned adjacent to said exterior wall interior surface, said probe body having an injection end and a fitting end, and sized to be removably insertable into a container, said probe body having a hollow gas injection chamber in said probe interior, extending substantially between said injection end and said fitting end, said gas injection chamber having a gas inlet positioned on said fitting end, said gas injection chamber having an opening on the exterior wall on said injection end, said gas injection heating probe further comprising a fluid inlet chamber and a fluid return chamber, said fluid inlet and fluid return chambers positioned in a substantially nested relationship wherein one of said fluid return chamber or fluid inlet chamber comprises a first wall, where said first wall comprises a portion of said exterior wall between said fitting end and said gas injection end; a heat exchange surface comprising a series of fins positioned in a spaced apart relationship on said exterior wall, each of said fins extending outwardly on said exterior wall, said heat exchange surface constructed of high thermal conductive material said probe body having a heating media inlet on said fitting end in fluid communication with said fluid inlet chamber, and a heating media outlet on said fitting end in fluid communication with said fluid return chamber, said fluid inlet chamber and fluid return chamber forming a closed fluid flow channel through said probe body between said fluid inlet and said fluid outlet, a source of pressurized gas coupled to said gas inlet and a source of heated fluid media coupled to said heating media inlet.

2. The gas injection heating probe of claim 1 further comprising a secure fitting positioned on said fitting end intermediary said heating media inlet and said injection end and intermediary said heating media outlet and said injection end, said secure fitting adapted to removably and sealingly couple said probe body to a container.

3. The gas injection heating probe of claim 1 where said gas injection chamber is nested within one of said fluid return chamber or said fluid inlet chamber.

4. The gas injection heating probe of claim 3 wherein said gas injection chamber is nested interior to both of said fluid return chamber and said fluid inlet chamber.

5. The gas injection heating probe of claim 1 further having a joint positioned between said injection end and said fitting end, said joint having an open and a close position, said joint, when opened, separating said probe body into two separate sections, where each section contains a portion of said fluid inlet chamber, fluid return chamber, and gas injection chamber, and when the joint is closed, each of said portions of said fluid inlet chamber and fluid outlet chamber and gas injection chamber being sealingly and fluidly coupled to the corresponding other portion.

6. A gas injection heating probe comprising a probe body comprising an exterior wall having an exterior surface and an interior surface, defining a probe interior positioned adjacent to said exterior wall interior surface, said probe body having an injection end and a fitting end, said gas injection probe configured to be removably insertable into a container, said probe body having a hollow gas injection chamber extending substantially between said injection end and said fitting end, said hollow gas injection chamber having a gas inlet positioned on said fitting end, said gas injection chamber having an opening through the exterior surface of the probe body on said injection end, said probe body further having a fluid inlet chamber and a fluid return chamber, one of said fluid return chamber or fluid inlet chamber having a chamber wall, whereby a portion of said exterior wall is common with a portion of said chamber wall, a heat exchange surface constructed of high thermal conductive material and comprising a series of fins positioned in a spaced apart relationship on said exterior wall, each of said fins extending outwardly on said exterior wall, said probe body having heating media inlet on said fitting end in fluid communication with said fluid inlet chamber, and a heating media outlet on said fitting end in fluid communication with said fluid return chamber, said fluid inlet chamber and fluid return chamber creating a closed fluid flow channel through said probe interior, each of said fluid inlet chamber and said fluid return chamber substantially located in the probe interior, said interior of said gas injection probe having a baffle system disposed therein, said baffle system defining said hollow gas injection chamber, said fluid inlet chamber, and said fluid return chamber, and a source of pressurized gas coupled to said gas inlet and a source of heated fluid media coupled to said heating media inlet.

* * * * *